United States Patent [19]

Fossati et al.

[11] Patent Number: 4,700,748

[45] Date of Patent: Oct. 20, 1987

[54] PRESSURE-REFERENCED PROGRAMMED FLOW CONTROL IN A HYDRAULIC VALVE

[75] Inventors: Giorgio Fossati, Monza; Harold Terry, Vedano Al Lambro; Giuseppe Manco, Agrate Brianza, all of Italy

[73] Assignee: Otis Elevator Company, Farmington, Conn.

[21] Appl. No.: 853,284

[22] Filed: Apr. 17, 1986

Related U.S. Application Data

[63] Continuation-in-part of Ser. No. 799,665, Nov. 18, 1985, abandoned.

[51] Int. Cl.[4] ..... F15B 13/044

[52] U.S. Cl. ..... 137/877; 91/446; 91/459; 137/115; 137/488; 137/522; 137/554; 137/625.3; 251/63.4; 251/129.11; 187/111

[58] Field of Search ..... 91/446, 459; 137/115, 137/488, 522, 554, 596.12, 625.3, 625.38, 877; 187/29 A, 29 B, 110, 111; 251/63.4, 129.05, 129.11

[56] References Cited

U.S. PATENT DOCUMENTS

| | | | |
|---|---|---|---|
| 3,391,702 | 7/1968 | Kast | 137/625.38 X |
| 3,842,943 | 10/1974 | Nakamura et al. | 91/454 X |
| 4,205,592 | 6/1980 | Haussler | 91/459 X |
| 4,239,179 | 12/1980 | Geier | 251/129.11 X |
| 4,318,332 | 3/1982 | Shingu et al. | 91/446 X |
| 4,340,086 | 7/1982 | Hemm et al. | 137/554 |
| 4,418,794 | 12/1983 | Manco | 91/459 X |

*Primary Examiner*—Gerald A. Michalsky

[57] ABSTRACT

The point at which pump out pressure exceeds load is sensed to provide a point for scheduling flow to an actuator in a hydraulic system. Flow is controlled by a stepper motor (28) that moves a flow control valve (27). The steps needed to achieve fixed flow changes are greater for high flow positions. When the pump (21) is turned on, the valve (27) is positioned to bypass flow; the bypass flow is then programmably decreased to the actuator. Reverse flow is regulated by the valve (27) to control actuator retraction. Reverse flow is initiated by opening a check valve (40) with an actuator (50) that opens it first to reduce pressure across the valve, then fully. The flow control valve (27) also operates to relieve excess pressure in the system.

5 Claims, 1 Drawing Figure

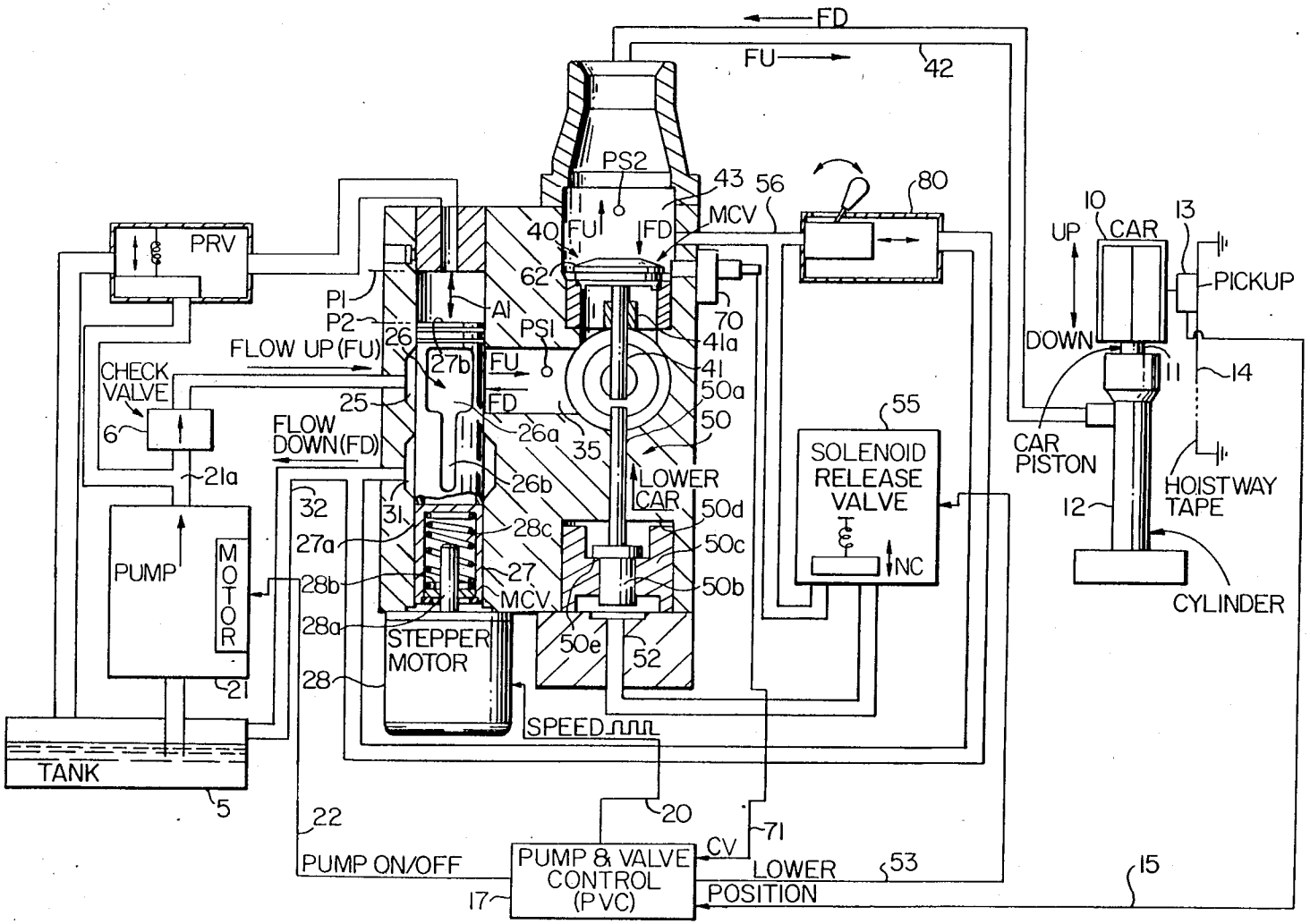
PICKUP
13
14
HOISTWAY TAPE
CYLINDER
CAR
10
11
UP
DOWN
CAR PISTON
12
15
FD
FU
42
80
55
SOLENOID RELEASE VALVE
NC
53
LOWER POSITION
71
CV
56
MCV
43
70
41a
41
50a
50
50d
50c
50b
LOWER CAR
52
20
PUMP & VALVE CONTROL (PVC)
PS2
IFD
FU
40
62
PS1
35
26a
26b
28c
27
MCV
50e
SPEED
17
A1
27b
FU
FD
STEPPER MOTOR
26
31
P1
P2
25
FLOW UP (FU)
FLOW DOWN (FD)
32
27a
28b
28a
28
22
PUMP ON/OFF
PRV
CHECK VALVE
6
21a
PUMP
MOTOR
21
5
TANK

PRESSURE-REFERENCED PROGRAMMED FLOW CONTROL IN A HYDRAULIC VALVE

This is a continuation-in-part of U.S. Ser. No. 799,665, filed Nov. 18, 1985, now abandoned.

Cross-Reference to Related Cases

This application shows apparatus described and claimed in the application titled "Pressure Relieving Linear Motion Valve", U.S. Ser. No. 799,765, now abandoned, and the application titled "Hydraulic Elevator with Dynamically Programmed Motor-Operated Valve", U.S. Ser. No. 799,666, now abandoned, by the same inventors and also assigned to the same assignee, Otis Elevator Company.

TECHNICAL FIELD

This invention concerns hydraulic valve control systems and, in particular, those used in hydraulic elevators.

BACKGROUND ART

In an attempt to control a hydraulic elevator with precision approximating the more sophisticated and usually more expensive traction elevators, feedback control is used. But, even using feedback control, comparable performance has been difficult to achieve, and the main problem is the dynamic characteristics of the fluid. Its viscosity shifts with the ambient temperature and also from the heating that occurs as the elevator car is raised and lowered. These variables produce some measure of unpredictability in the motion of the elevator car. The different levels of feedback that have been utilized are typically expensive and require excess pump capacity, which increases the cost and lowers system efficiency.

A technique illustrating feedback is shown in U.S. Pat. No. 4,205,592, where the flow through the valve and to an object, such as a hydraulic elevator, is passed through a flow meter that includes a potentiometer. As the flow increases, the output voltage associated with the motion of the potentiometer wiper changes, manifesting the magnitude of the flow. U.S. Pat. No. 4,381,699 shows a similar type of valve control.

U.S. Pat. No. 4,418,794 is illustrative of the type of valve that may be used in systems that do not sense the fluid flow but, using a larger feedback loop, perhaps sense the position of the elevator car and control the operation of the valve.

DISCLOSURE OF INVENTION

According to the present invention, a main valve is operated to control the flow from a pump to the object, such as an elevator car. The time-related motion of this valve mirrors the flow to the car, thus also the car's velocity profile. The operation of the valve begins by placing it in a position at which the fluid from the pump is completely bypassed from the car. The valve is then progressively closed, decreasing that bypass flow. When the pressure applied to the elevator car exceeds the pressure required to sustain the car, motion of the valve is programmed to the desired elevator velocity profile. The pressure differential that arises when the output pump pressure just exceeds the pressure required to hold the car in place is sensed from the motion of a check valve across which the pump pressure and car pressure are oppositely applied. Movement of the check valve to an open position at which the car will just about start to move is detected by an electrical switch that produces an electrical control signal that is applied to the main valve control. That control signal acts as the starting point for main valve programmed positioning that determines the velocity profile of the elevator car.

According to another aspect of the invention, the acceleration jerk-in, constant acceleration, acceleration jerk-out, deceleration jerk-in, constant deceleration and deceleration jerk-out segments of the car velocity are controlled ostensibly by controlling the window area of the valve windows with a stepping motor and providing constant gain between each motor step and window area throughout the entire elevator run.

BRIEF DESCRIPTION OF THE DRAWING

The drawing is a schematic showing a hydraulic elevator control system embodying the present invention.

BEST MODE FOR CARRYING OUT THE INVENTION

FIG. 1 shows a hydraulic elevator control system for moving an elevator car 10 between a plurality of floors or landings. The floors or landings are not shown. The car is attached to a car piston (plunger) 11 that extends from a cylinder 12, and fluid is pumped into or discharged from the cylinder to raise and lower the car respectively, that flow being controlled and regulated in a manner that will be described in detail. The motion of the car is detected by a pickup 13. Associated with a stationary position tape 14, the pickup provides a signal (POSITION) on line 15, that is supplied to a pump and valve control (PVC) 17. The POSITION signal manifests the car position and velocity. The position of the car thus sensed is used for controlling the flow of fluid between the cylinder, controlling the position of the car piston or plunger 11. The PVC 17 controls a hydraulic valve system that includes a pump 21 and a fluid reservoir (tank) 5. The pump supplies fluid to a hydraulic control valve assembly through a check valve 6 (to prevent back flow), and this assembly is controlled, along with the pump, by the PVC 17. The pump is turned on or off (activated/deactivated) by a pump on/off signal on a line 22, and the fluid from the pump is applied under pressure through the check valve 6 to a first port 25.

The port 25 leads to a "key-shaped" valve window 26 that is part of a linear valve 27, one that moves back and forth linearly between two positions P1, P2. The position of the valve 27 is controlled by a stepper motor 28 which receives a signal (SPEED) on the line 20 from the PVC 17. That signal comprises successive pulses, and the frequency of those pulses determines the motor's 28 speed; hence also the longitudinal (see arrow A1) rate of positioning of the valve 27. Each pulse in the SPEED signal represents an incremental distance along the length of motion of the valve 27 between points P1 and P2. The position (location) of the valve is represented by the accumulated count between those positions. The valve window 26 comprises a large window **26*a* and an adjacent narrower window 26*b*, giving it a "key-shaped" appearance. At one point, P2, the large window 26*a* is adjacent the first inlet port 25, and the narrower adjacent portion 26*b* is located next to a second port 31. At this point, the valve 27 is "open". That second port 31 leads to a line 32 that goes to the tank 5. At position P1, the small window 26*b* is mostly adjacent to the port 25, and the path to the port 31 is blocked by the solid part of the valve. At that position, the valve 27 is "closed". In the open position, at P2, fluid flows from the pump through the line 21***a* this is "flow-up" (FU), flow to raise the car. The fluid then passes into the large window 26*a* and, from there, through the small window 26*b* back to the line 32, then to the tank. The FU flow is thus bypassed when the pump is started. But, as the valve 27 closes (moves to position P1), the pressure of the FU fluid flow begins to build in an internal port 35, while the bypass flow on line 32 decreases as the path through window 26*b* to port 31 decreases. As the valve 27 moves to position P1 (nonbypass position), there is some overlap of the two windows 26*a*, 26*b* and the main inlet port 25, meaning that the path through the large window 26*a* decreases, while the path through the smaller window 26*b* increases. But, the area of the smaller window 26*b* is more dependent than with the case of the larger window on the longitudinal position of the valve 27. As a result of this, the change in flow is controlled by the smaller valve window area to outlet port 31, which reduces as the main valve begins to move towards the closed position at P1, at which all the FU flow passes from the port 25 to the inlet 35; there being no path between the port 25 and the outlet port 31.

The fluid pressure PS1 in the internal port 35 is applied to a main check valve (MCV) 40. This valve has a small stem 41 that rests in a guide 41*a*. The MCV may freely move up and down in response to the pressure differentials between the port 35 and the port 43, where the pressures are PS1 and PS2, respectively. When the pump is turned on and the main valve 27 closes, moves towards position P1, the MCV 40 is pushed upward when PS1 exceeds PS2, allowing the FU flow to pass through the MCV into the line 42 that extends to the cylinder 12. This happens as the bypass flow decreases. The resultant fluid flow displaces the car piston 11 upward, moving the car in the same direction.

When the car 10 is at rest, pressure in the line 42 and the pressure in the chamber 43 are the same, pressure PS2. With the pump 21 off, this pressure pushes the MCV 40 down, and the down flow (FD) in the line 42 is then blocked, holding the car 10 in position. No flow through the line 42 and back to the tank 5 is possible under this condition. To allow this flow to occur, the MCV 40 must be lifted, and this is effected by the operation of a main check valve actuator 50.

This actuator includes a rod 50*a*, which contacts the stem 41 when pushed upward; a first member 50*b* which is pushed upward against the rod; a second member 50*c* which when pushed upward moves the first member. The rod 50*a* is thrust upward, pushing the MCV 40 upward, when fluid, at pressure PS2, is applied to the inlet line 52, and that happens only when a LOWER signal is applied to the line 53 that goes to a solenoid control release valve 55. The fluid pressure in the line 52 is then applied to the bottom of the members (pistons) 50*b*, 50*c*. The combined surface area of those members is greater than the upper surface area 62 of the valve 40. The second member moves until it strikes the wall 50*d*. The first member also moves with the second member because of the flange 50*e*. This small motion (as far as the wall 50*d*) "cracks" open the MCV 40, equalizing the pressures PS1 and PS2. Then the first member continues to move upward, until it too strikes the wall, fully opening the MCV 40. This allows return flow (CFD) from the chamber 35 that passes through the windows 26*a*, 26*b*, and line 32. The FD flow through line 25 is blocked by the check valve 6. The position of the valve 27 determines the rate of the FD flow, thus the speed profile of the car as it descends. The valve is moved from the closed P1 position by the SPEED signal towards the open position P2. The duration and frequency of the SPEED signal sets the down velocity profile.

There is switch 70 that is adjacent the MCV 40, and the upward motion of the MCV 40 causes the switch to operate. That operation provides a signal (CV) on the line 71 going to the PVC 17. The CV signal shows that the valve in the up direction for elevator travel has moved. It represents that the pressure in the chamber 35 has slightly exceeded the pressure in the chamber 43. Using this signal, the PVC may control the further motion of the valve spool by controlling the pulse rate and duration comprising the SPEED signal, which is applied to the line 20. The CV signal occurs just when the pressure of PS1 35 exceeds the pressure PS2, and that occurs just before there is actual flow. Generation of the CV signal consequently provides a definitive manifestation of "anticipated" flow.

The stepper motor controlled valve 27 also provides a pressure release function for the port 35. The stepper motor 28 has an output link 28*a*, and a collar or ring 28*b* is attached to that link. The link and collar fit in a hollow portion of the valve 27 but separated from the flow area (windows 26*a*, 26*b*) by the valve wall 27*a*, which is opposite another wall 27*b*. (The valve 27 is shaped like a hollow cylinder; fluid flows through its interior). A spring 28*c* fits between the wall and the collar 28*b*. As the stepper motor operates, the link moves up or down, in steps corresponding to the steps in the SPEED signal. As a result of this, the change in flow is controlled by the smaller valve window area to outlet port 31, which reduces as the main valve begins to move towards the closed position at P1, at which all the FU flow passes from the port 25 to the inlet 35; there being no path between the port 25 and the outlet port 31. This link motion is transmitted to the wall 27*a* through the spring to the valve 27, which moves in synchronism with the link. If the pressure in the pump output line 21*a* is sufficient to open the pressure release valve (PRV), the pressure is applied to the top of the valve 27*b* and the entire valve 27 is forced down, allowing the flow from the pump to pass through the line 32, to the tank 5, to relieve the "overpressure" condition.

For manually lowering the car, a manually operated valve 80 is operated to allow the fluid to flow from the chamber directly back to the tank 5.

The preferred embodiment of the invention has been described, and one of ordinary skill in the art to which the invention relates may make modifications and variations to that embodiment, in whole or part, without departing from the true scope and spirit of the invention.

We claim:

1. A hydraulic valve comprising:

a main inlet adapted for connection to a pump;

a main outlet adapted for connection to an actuator comprising a piston and a cylinder;

a secondary outlet adapted for connection to a fluid tank;

a flow control valve for controlling fluid flow from the main inlet to the main outlet;

the hydraulic valve being characterized by:

a check valve with its inlet connected to the flow control valve and its outlet connected to the main outlet, the check valve being operable to open and connect its inlet and outlet when the pressure in the inlet exceeds the pressure in the outlet and also being mechanically operable to open;

a switch that is actuated by the motion of the check valve when the check valve opens and closes;

the flow control valve being continuously movable between two positions to control from a minimum to a maximum equaling the pump output to flow between the main inlet and the main outlet through the check valve and discharge from the main outlet to the tank;

a hydraulic actuator that opens the check valve by applying a first force to open the check valve slightly to allow the pressure to equalize on each side of the check valve and by subsequently applying a lower second force to additionally open the check valve;

a solenoid valve operable for applying fluid under pressure to move the hydraulic actuator to said first and second positions.

2. A valve according to claim 1, characterized in that the actuator comprises:

a first pressure responsive member and a second pressure responsive member that can move simultaneously for a first distance to slightly open the valve, the second member being additionally movable beyond that first distance to open the valve further, the combined surface area of the two members being greater than that area of the valve, so that the force of the two members exceeds the opposing force of the valve caused by the inlet pressure.

3. A valve according to claim 1, further characterized by:

a stepper motor; and the flow control valve being a linear motion valve, and the stepper motor being connected to the valve for moving it linearly in finite steps in response to a stepper signal, the stepper signal comprising variable frequency pulses.

4. A valve according to claim 1, further characterized by:

the flow control valve being a hollow cylinder containing first and second adjacent flow control windows, the first window being larger than the second, the change in flow through area of the first window, as compared to the second, changing more for each unit of linear valve movement, the bypass flow being through both windows, and the full flow from the pump to the check valve being through the first window.

5. In combination, a hydraulic valve comprising:

a main inlet adapted for connection to a pump;

a main outlet adapted for connection to an actuator comprising a piston and a cylinder;

a secondary outlet adapted for connection to a fluid tank;

a flow control valve for controlling fluid flow from the main inlet to the main outlet; and positioning means for controlling the position of the flow control valve;

the hydraulic valve being characterized by:

a check valve with its inlet connected to the flow control valve and its outlet connected to the main outlet, the check valve being operable to open and connect its inlet and outlet when the pressure in the inlet exceeds the pressure in the outlet and also being mechanically operable to open;

a switch that is actuated by the motion of the check valve when the check valve opens and closes;

the flow control valve being continuously movable between two positions to control from a minimum to a maximum equaling the pump output to flow between the main inlet and the main outlet through the check valve and discharge from the main outlet to the tank; and said positioning means being characterized in that it comprises means for increasing the flow between the main inlet and the main outlet commencing when said switch is actuated.

* * * * *